US007048645B2

(12) United States Patent
Kumamoto

(10) Patent No.: US 7,048,645 B2
(45) Date of Patent: May 23, 2006

(54) GOLF CLUB SHAFT

(75) Inventor: Tomio Kumamoto, Hyogo (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 10/715,474

(22) Filed: Nov. 19, 2003

(65) Prior Publication Data

US 2004/0102256 A1 May 27, 2004

(30) Foreign Application Priority Data

Nov. 20, 2002 (JP) ..... 2002-336783

(51) Int. Cl.
*A63B 53/10* (2006.01)

(52) U.S. Cl. ..... 473/319

(58) Field of Classification Search ..... 473/316–323
See application file for complete search history.

(56) References Cited

U.S. PATENT DOCUMENTS 5,265,872 A * 11/1993 Tennent et al. ..... 473/320
6,056,648 A * 5/2000 Kusumoto et al. ..... 473/319
6,110,056 A * 8/2000 Yamamoto ..... 473/289
6,273,830 B1 * 8/2001 Takemura et al. ..... 473/319

FOREIGN PATENT DOCUMENTS

JP 9-234256 A 9/1997
JP 2000-263653 A 9/2000

* cited by examiner

*Primary Examiner*—Stephen Blau
(74) *Attorney, Agent, or Firm*—Birch Stewart Kolasch & Birch LLP

(57) ABSTRACT

A golf club shaft whose outer diameter is set to 9.5 to 12 mm in at least one portion of a range from a tip thereof to a position located at 25% of the distance from the tip to its butt. The minimum value of a flexural rigidity (EI) is set to 1.00 to 2.50 kg·m$^2$. A reinforcing layer is formed in the region disposed from the tip to the position located at about 25% of the distance from the tip to the butt. The layer includes at least one straight layer whose reinforcing fiber has a tensile modulus of elasticity of 5 to 15 ton/mm$^2$ and is parallel with an axis of the shaft and one angular layer whose reinforcing fiber has a tensile modulus of elasticity of 24 to 40 ton/mm$^2$ and an orientation angle of ±20 to 65°.

5 Claims, 2 Drawing Sheets

GOLF CLUB SHAFT

This Nonprovisional application claims priority under 35 U.S.C. § 119(a) on patent application No(s). 2002-336783 filed in JAPAN on Nov. 20, 2002, the entire contents of which are hereby incorporated by reference.

BACKGROUND OF THE INVENTION

1. Field of the Invention

The present invention relates to a golf club shaft and more particularly to a golf club shaft in which the center of gravity of the head is lowered in such a way as to maintain the strength of the shaft at its tip side on which a head is mounted and which is flexible to fly a golf ball at a large elevation angle.

2. Description of the Related Art

In recent years, a golf club shaft composed of a reinforcing fiber such as a carbon fiber having a high specific strength and a high specific rigidity is manufactured and commercially available. As the specific strength and the specific rigidity of the carbon fiber become higher, a light-weight golf club shaft can be manufactured.

To allow the golf ball to fly in a high trajectory, there is a tendency that the center of gravity of the head is located at a lower position thereof and that the neck (portion on which shaft is mounted) of the head is short and thin. As the neck becomes short and thin, a higher stress is applied to the tip side of the shaft. Therefore it is very important that the tip side has a high strength.

If the diameter of the shaft at it tip side to increase the strength of the tip side, the degree of the flexural rigidity of the shaft becomes high, which causes the golf ball to fly in a low trajectory. Therefore there is a decrease in the effect to be brought about by lowering the center of gravity of the head to fly the golf ball in a high trajectory.

To enhance the torque strength (torsional rigidity) at the tip side of the shaft, a shaft is proposed as disclosed in Japanese Patent Application Laid-Open No. 9-234256. The shaft has the fiber reinforced resin sheet disposed at both the tip side on which the head is mounted and the butt side on which the grip is mounted. The reinforcing fiber of the fiber reinforced resin sheet forms an orientation angle of 35° to 45° with respect to the axis of the shaft. The fiber reinforced resin sheet, parallel with the axis of the shaft, forming the straight layer is also disposed at the central portion of the shaft. The region having a high torsional rigidity is formed at both the tip side and the butt side. The region having a high flexural rigidity is formed at the central portion of the shaft.

A tubular member for use in a golf club shaft is disclosed in Japanese Patent Application Laid-Open No. 2000-263653. In the tubular member, the fiber reinforced resin sheet having a low elasticity is used over the entire length of the shaft. More specifically, the tubular member is entirely composed of the fiber reinforced composite material having a high torsional strength.

In the shaft disclosed in Japanese Patent Application Laid-Open No. 9-234256, although the angular layer is disposed at the tip side to enhance the torsional strength of the shaft, the shaft is incapable of flying a golf ball in a high trajectory. In the case where the diameter of the tip side is enlarged to lower the center of gravity of the head, the torsional rigidity of the tip side becomes large. Thus the shaft is incapable of flying the golf ball in a high trajectory.

The tubular member disclosed in Japanese Patent Application Laid-Open No.2000-263653 has little effect for flexing and twisting the shaft because the fiber having a low elasticity is disposed over the entire length of the shaft. Therefore the shaft composed of the tubular member is incapable of increasing the flight distance of the golf ball. Further the shaft has a bad flying-distance capacity and a bad directional property gives a bad feeling to a golf player.

SUMMARY OF THE INVENTION

The present invention has been made in view of the above-described problems. Therefore it is an object of the present invention to provide a golf club shaft having a large diameter at its tip side to allow the tip side to have a high strength and allowing the golf ball to fly in a high trajectory by setting the torsional rigidity and flexural rigidity of the shaft appropriately.

To achieve the object, according to the present invention, there is provided a golf club shaft, composed of a fiber reinforced resin, whose outer diameter is set to 9.5 to 12 mm in at least one portion of a range from a tip thereof disposed at a head-mounting side to a position located at 25% of a distance from the tip to a butt thereof; and a minimum value of a flexural rigidity (EI) in the range is set to 1.00 to 2.50 $kg \cdot m^2$.

As described above, the outer diameter of the shaft is set to 9.5 mm to 12 mm larger than that (9.0 mm) of ordinary shafts in at least one portion of the range from the tip of the shaft to the position located at 25% of the distance from the tip to its butt and more favorably in the range from the tip of the shaft to the position located 10% of the distance from the tip to the butt, namely, in the region covering the portion of the shaft inserted into the hose 1 of the neck of the head and the portion of the shaft projected a certain distance from the neck. Thereby the strength of the shaft can be enhanced. Therefore when the shaft is mounted on the head which is thin and has a short neck to lower its center of gravity, the shaft is capable of withstanding an increased load applied to the tip side thereof.

The outer diameter of the shaft at its tip side is set to 9.5 mm to 12 mm for the following reason: If the outer diameter of the shaft at its tip side is less than 9.5 mm, the diameter of the tip side is so small that the tip side is liable to be broken. On the other hand, if the outer diameter of the shaft at its tip side is more than 12.0 mm, the value of the flexural rigidity (EI) becomes so large that it is impossible to make the shaft sufficiently flexural.

Merely enlarging the outer diameter of the shaft at its tip side makes the rigidity thereof so high that a ball hit with the shaft flies in a low trajectory. Thus in the range of the shaft in which the outer diameter is set larger, the minimum value of the flexural rigidity (EI) of the golf club shaft is set to 1.00 to 2.50 $kg \cdot m^2$ to allow the flexural rigidity (EI) to be proper. Therefore the shaft is allowed to be flexible without deteriorating the strength at its tip side. Thus the golf ball has a large elevation angle when it is hit and flies in a high trajectory.

The outer diameter of the shaft is set to 9.5 to 12 mm in the range from the tip thereof to the position located at 25% of the distance from the tip to the butt, and the minimum value of the flexural rigidity (EI) of the shaft in the above-described range is set to 1.00 to 2.50 $kg \cdot m^2$ for the following reason: If the set range exceeds 25% of the whole length of the shaft and extends toward the central portion thereof, the tip side flexes to a high extent. Thus the timing of the return of the head lags behind a desired impact timing. Therefore a player cannot hit the golf ball at a high head speed.

The minimum value of the flexural rigidity (EI) in the range from the tip to the position located at 25% of the distance from the tip to the butt is set to the range of 1.00 to 2.50 kg·m$^2$ for the following reason: If the minimum value of the flexural rigidity (EI) is less than 1.00 kg·m$^2$, the shaft is so flexible that the timing of the return of the head lags behind the desired impact timing. Consequently the flight speed of the golf ball cannot be increased. If the minimum value of the flexural rigidity (EI) is more than 2.50 kg·m$^2$, the shaft has a low degree of flexibility at its tip side. That is, the shaft is incapable of flexing sufficiently.

A reinforcing layer is formed in the region disposed from the tip to the position located at 25% of the distance from the tip to the butt. The reinforcing layer includes at least one straight layer consisting of a prepreg whose reinforcing fiber has a tensile modulus of elasticity of 5 to 15 ton/mm$^2$ and is substantially parallel with an axis of the shaft; and at least one angular layer consisting of a prepreg whose reinforcing fiber has a tensile modulus of elasticity of 24 to 40 ton/mm$^2$ and an orientation angle of ±20 to 65° with respect to the axis of the shaft.

Reinforcing fibers such as carbon fibers are impregnated in a matrix resin to form prepregs. The formed prepregs are layered one upon another in a pipelike shape to form the golf club shaft of the present invention. The reinforcing layer including the straight layer and the angular layer is formed at the tip side of the shaft.

The shaft is allowed to be flexible by using the prepreg reinforced with the reinforcing fiber consisting of carbon fibers having a low tensile modulus of elasticity as the reinforcing straight layer. The tip side of the shaft can be reinforced by using the prepreg reinforced with the reinforcing fiber consisting of the carbon fibers having a moderate high tensile modulus of elasticity as the reinforcing angular layer having the orientation angle of ±20 to 65°.

The straight layer affects the value of the flexural rigidity (EI value) greatly. Thus the reinforcing straight layer consists of the prepreg reinforced with the fiber having the low tensile modulus of elasticity of favorably 5 to 15 ton/mm$^2$ and more favorably 8 to 12 ton/mm$^2$.

The reason the tensile modulus of elasticity of the reinforcing fiber of the tip-side reinforcing straight layer is set to 5 to 15 ton/mm$^2$ is as follows: If the tensile modulus of elasticity of the reinforcing fiber of the reinforcing straight layer is less than 5 ton/mm$^2$, the value of the flexural rigidity (EI value) becomes so small that the head returns so much that the golf ball flies in a very high trajectory. Consequently the flight distance of the golf ball cannot be increased. On the other hand, if the tensile modulus of elasticity of the reinforcing fiber of the reinforcing straight layer is more than 15 ton/mm$^2$, the value of the flexural rigidity (EI value) becomes so large that the shaft cannot be flexed sufficiently.

The reason the reinforcing fiber composing the reinforcing angular layer has the tensile modulus of elasticity of 24 to 40 ton/mm$^2$ (intermediate elasticity and high strength) is as follows: If the tensile modulus of elasticity of the reinforcing fiber of the reinforcing angular layer is less than 24 ton/mm$^2$, the shaft has a low torsional strength generated at its tip. Consequently there is a fear that the shaft is broken at its tip side. On the other hand, if the tensile modulus of elasticity of the reinforcing fiber of the reinforcing angular layer is more than 40 ton/mm$^2$, the shaft is so hard that the shaft gives the player a bad feeling and has a very low strength and fragility.

The reason the reinforcing fiber of the reinforcing angular layer has the orientation angle of ±20 to 65° with respect to the axis of the shaft is as follows: If the reinforcing fiber of the reinforcing angular layer has an orientation angle less than ±20°, namely, a small orientation angle, the shaft has a high flexural rigidity (EI) value at its tip side and flexes to a low degree. On the other hand, if the reinforcing fiber of the reinforcing angular layer has an orientation angle more than ±65°, the shaft has a high strength in a breakage direction, but has a low strength in the bending direction, which causes the shaft to be broken in practical use.

It is preferable that the ratio of the weight of the tip-side reinforcing straight layer to that of the tip-side reinforcing angular layer is set to 0.5 to 1.0.

The ratio of the weight of reinforcing the straight layer to that of the reinforcing angular layer is set to 0.5 to 1.0 for the reason described below: If the weight ratio is less than 0.5, the value of flexural rigidity (EI) becomes too small and the timing of the return of the head lags behind the desired impact timing. That is, a golf club composed of the shaft cannot be controlled favorably. On the other hand, if the weigh ratio is more than 1.0, the value of the flexural rigidity (EI) becomes so large that the shaft is hardly flexible. Thus the player has difficulty in swinging the shaft.

Similarly to the conventional shaft, prepregs constituting the straight layer and those constituting the angular layer are layered one upon another in appropriate combinations to form the shaft of the present invention. As necessary, a hoop layer vertical to the axis of the shaft is used to compose the shaft. In compliance with demanded performances, the configuration, thickness, and position of the prepregs, the number thereof to be layered, and the number of turns thereof are appropriately adjusted.

Except the prepreg, reinforced with the carbon fiber having the intermediate elasticity and the high strength, which composes the tip-side reinforcing angular layer and the prepreg, reinforced with the carbon fiber having the low elasticity, which composes the tip-side reinforcing straight layer, it is possible to appropriately alter the fibrous angle of the reinforcing fiber of the prepreg, the tensile modulus of elasticity thereof, and the tensile strength thereof within the range in which the alteration does not reduce the effect of the present invention.

As the matrix resin which impregnates the reinforcing fiber, both thermosetting resin and thermoplastic resin can be used singly or in combination. But the thermosetting resin is more favorable the thermoplastic resin in terms of strength and rigidity. Epoxy resin is particularly preferable. Besides the epoxy resin, unsaturated polyester resin (vinyl ester resin) can be used as the thermosetting resin. As the thermoplastic resin, polyamide resin and saturated polyester resin can be used.

The golf club shaft of the present invention is applicable to all kinds of golf clubs. For example, a wooden head or an iron head or putter can be mounted on the golf club shaft of the present invention.

DETAILED DESCRIPTION OF THE PREFERRED EMBODIMENTS

The embodiments of the present invention will be described below with reference to drawings.

Figure 1:
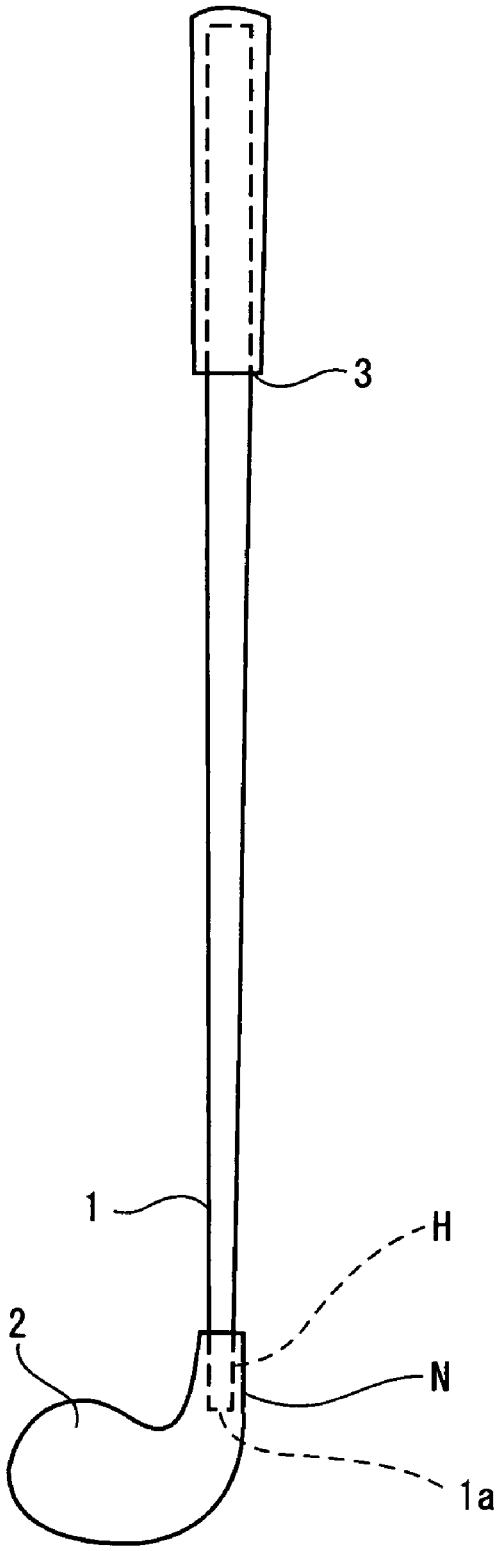
FIG. 1 is a schematic view showing a golf club shaft according to the present invention.
Figure 2:
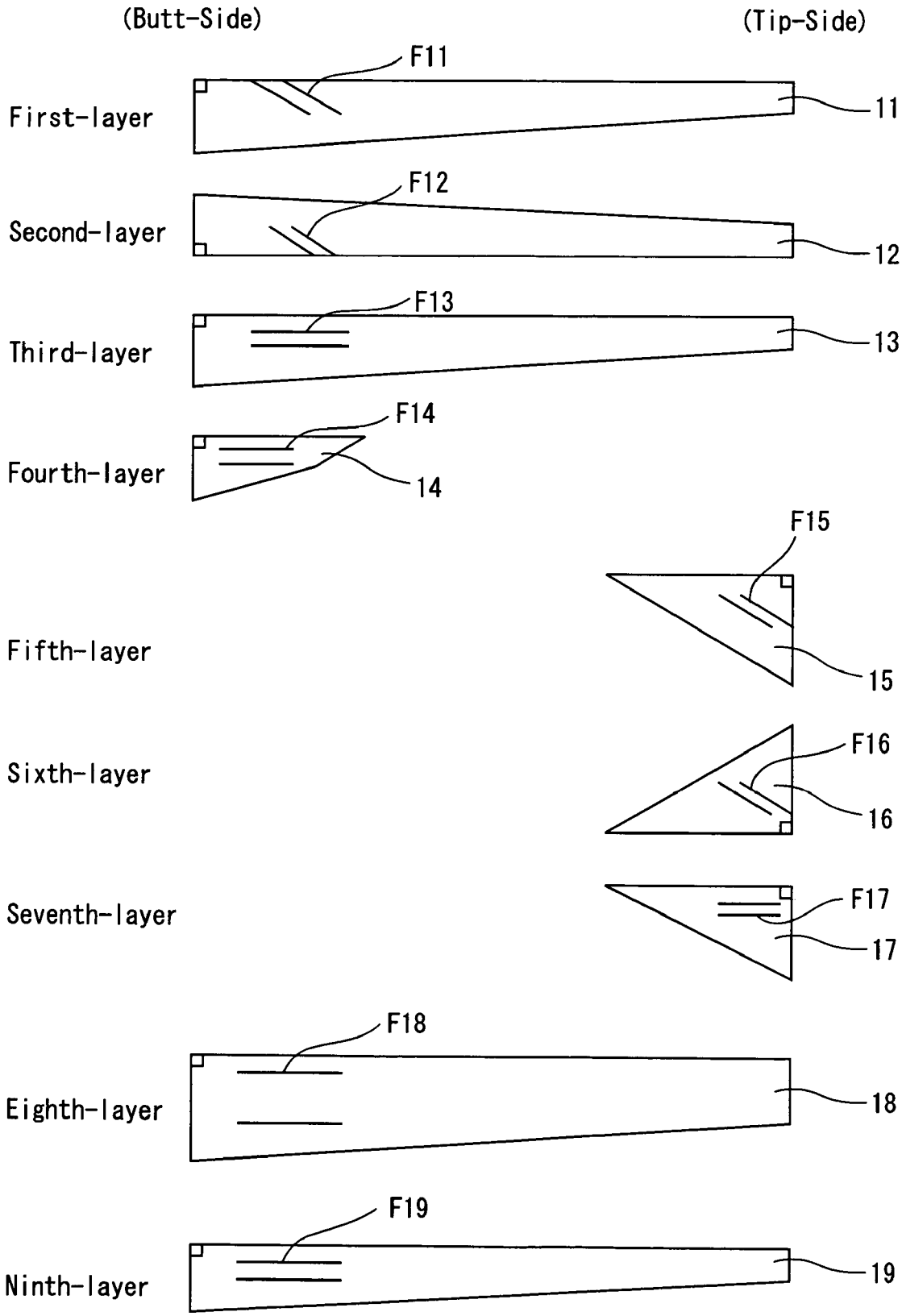
FIG. 2 shows a layering construction of fiber reinforced prepregs.

FIGS. 1 and 2 show a golf club shaft (hereinafter often referred to as shaft) according to an embodiment of the present invention. Prepregs are layered one upon another in such a way that the laminate of the prepregs is tubular. A head 2 is installed on the shaft 1 at the tip (T) thereof having the smaller diameter. A grip 3 is installed on the shaft 1 at the butt (B) thereof having the larger diameter. The shaft 1 is tapered linearly from the butt to the tip.

The outer diameter of the shaft 1 at its tip 1*a* is set larger than that (not more than 9 mm) of ordinary shafts. That is, the outer diameter of the tip 1*a* is set to the range of 9.5 to 12 mm. The outer diameter of the shaft 1 is set to 10.0 mm in the embodiment. The whole length of the shaft 1 is set to 991 mm.

The shaft 1 is manufactured by a sheet winding manufacturing method as follows: After prepregs 11 through 19 are impregnated with thermosetting resin with the prepregs 11 through 19 arranged parallel with one another, they are layered sequentially (prepregs 11→12→ . . . 19) around a core metal (not shown in the drawings) from the inner peripheral side thereof to the peripheral side thereof. The prepregs 11 through 19 are lapped by pressurizing them with a tape made of polyethylene (PE) or polyethylene terephthalate (PET). Thereafter they are integrally molded by heating them under pressure in an oven to harden the resin. Thereafter the core metal is drawn from the laminate. In this manner, the shaft 1 is formed.

Reinforcing fibers F11 through F19 of the prepregs 11 through 19 consist of carbon fiber. Epoxy resin is used as the matrix resin of the prepregs 11 through 19.

The first-layer prepreg 11 through the ninth-layer prepreg 19 are constructed as shown in FIG. 2. The prepregs 11, 12, 13, 18, and 19 are disposed over the entire length of the shaft 1. The prepreg 14 reinforces the butt side of the shaft 1. The prepregs 15, 16, and 17 reinforce the tip side thereof.

In the inner most-layer prepreg 11 and the second-layer prepreg 12, the tensile modulus of elasticity of each of reinforcing fibers F11 and F12 is set to 30 ton/mm$^2$. The orientation angle of the reinforcing fiber F11 and that of the reinforcing fiber F12 with respect to the axis of the shaft 1 are set to −45° and +45° respectively. That is, the prepregs 11 and 12 constitute an angular layer respectively. Each of the prepregs 12 and 13 has a length equal to the overall length of the shaft 1 and are wound in two plies respectively.

The tensile modulus of elasticity of a reinforcing fiber F13 of the third-layer prepreg 13 is set to 24 ton/mm$^2$. The orientation angle of the reinforcing fiber F13 with respect to the axis of the shaft 1 is set to 0°. The third-layer prepreg 13 constitutes a straight layer. The prepreg 13 has a length equal to the overall length of the shaft 1 and is wound in one ply.

The fourth-layer prepreg 14 constitutes a butt-side reinforcing straight layer. The tensile modulus of elasticity of a reinforcing fiber F14 is set to 30 ton/mm$^2$. The orientation angle of the reinforcing fiber F14 with respect to the axis of the shaft 1 is set to 0°. The length of the longer side of the prepreg 14 and that of the shorter side thereof in the axial direction of the shaft 1 are set to 300 mm and 200 mm respectively. The prepreg 14 is wound in one ply.

The fifth-layer prepreg 15, the sixth-layer prepreg 16, and the seventh-layer prepreg 17 constitute tip-side reinforcing layers. The fifth-layer prepreg 15 and the sixth-layer prepreg 16 constitute angular layers. The seventh-layer prepreg 17 constitutes a straight layer.

The tensile modulus of elasticity of a reinforcing fiber F15 of the prepreg 15 and that of a reinforcing fiber F16 of the prepreg 16 are set to 24 ton/mm$^2$ respectively. The orientation angle of the reinforcing fiber F15 and that of the reinforcing fiber F16 with respect to the axis of the shaft 1 are set to −45° and +45° respectively. The triangular fifth-layer prepreg 15 and the triangular sixth-layer prepreg 16 are formed in the range from the tip of the shaft 1 to a position located about 20% of the distance from the tip to the butt. The fifth-layer prepreg 15 and the sixth-layer prepreg 16 are wound in four plies respectively.

The tensile modulus of elasticity of a reinforcing fiber F17 of the seventh-layer prepreg 17 is set to 10 ton/mm$^2$. The orientation angle of the reinforcing fiber F17 with respect to the axis of the shaft 1 is set to 0°. The length of the prepreg 17 in the axial direction of the shaft 1 is 200 mm triangular equal to the axial length of the fifth-layer prepreg 15 and that of the sixth-layer prepreg 16. The seventh-layer prepreg 17 is disposed from the tip to a position located about 20% of the distance from the tip to the butt. The seventh-layer prepreg 17 is wound in four plies.

The eighth-layer and ninth-layer prepregs 18 and 19 constitute the straight layer are disposed over the entire axial length of the shaft 1. The tensile modulus of elasticity of each of reinforcing fibers F18 and F19 is set to 24 ton/mm$^2$. The reinforcing fibers F18 and F19 are parallel with the axis of the shaft 1. The eighth-layer and ninth-layer prepregs 18 and 19 are wound in one ply respectively.

The ratio of the weight M1 of the tip-side reinforcing straight layer to the weight M2 of the tip-side reinforcing angular layer is set to the range of 0.5 to 1.0. In the embodiment, the weight ratio M1/M2 is set to 0.7.

The minimum value of the flexural rigidity (EI) of the shaft 1 in the range from its tip to a position located at 25% of the distance from the tip to the butt is set to the range of 1.00 to 2.50 kg m$^2$. In the embodiment, the minimum value of the flexural rigidity (EI) is set to 1.25 kg m$^2$.

As described above, in the range from the tip of the shaft to the position located at 25% of the distance from the tip 1*a* to its butt, the outer diameter of the shaft 1 is set to the range of 9.5 to 12 mm larger than that of ordinary shafts. In the embodiment, the outer diameter of the shaft 1 is set to 10.0 mm. Thus it is possible to make the circumferential bonding area of the shaft 1 which is inserted into a hosel H formed at a neck N of the head 2 and bonded thereto. Therefore even though the head 2 is thin and has the short neck N to lower the center of gravity of the head 2, it is possible to bond the shaft 1 and the head 2 to each other at a high strength. Since the diameter of the shaft 1 at its tip side is set large, the strength of the shaft 1 can be increased. Thereby it is possible to prevent the shaft 1 from being broken in the vicinity of the neck N of the head 2 when a stress is applied to the shaft 1 at its tip side.

As described above, the tip side of the shaft 1 is provided with one straight layer consisting of the prepreg 17 reinforced with the reinforcing fiber having a low tensile modulus of elasticity and two angular layers consisting of the prepregs 15 and 16 reinforced with the reinforcing fiber having a moderate high tensile modulus of elasticity. The minimum value of the flexural rigidity (EI) in the range from the tip of the shaft 1 to the position located at 25% of the distance from the tip to the butt is set to the range of 1.00 to 2.50 kg·m$^2$ to allow the shaft 1 to have a proper degree of flexibility. In the embodiment, the minimum value of the flexural rigidity (EI) is set to 1.25 kg·m$^2$. Therefore even though the strength of the shaft 1 at its tip side is enhanced by increasing the diameter of the tip, the shaft 1 is allowed to be sufficiently flexible without making the rigidity of the shaft 1 too high.

As described above, the reinforcing layer allows the shaft to have a large diameter at its tip side, does not deteriorate its strength, and reduces a shock at a ball-hitting time. Further the reinforcing layer prevents breakage of the shaft. The tip-side is provided with the reinforcing angular layer and the reinforcing straight layer having a low tensile modulus of elasticity. Therefore the shaft of the present invention gives a good feeling to a player when the player hits a golf ball and allows the golf ball to fly in a high trajectory. That is, the shaft has enhanced directional property.

The following reinforcing fibers each having the following tensile modulus of elasticity are used for the above-described prepregs:

As the reinforcing fiber having the tensile modulus of elasticity of 24 ton/mm$^2$, the product 700GC manufactured by Toray Industries Inc. and the product of TR series manufactured by Mitsubishi Rayon Inc. were used.

As the reinforcing fiber having the tensile modulus of elasticity of 30 ton/mm$^2$, the product of MR series (MR40) manufactured by Mitsubishi Rayon Inc. and the product 800H and M30 manufactured by Toray Industries Inc. were used.

As the reinforcing fiber having the tensile modulus of elasticity of 40 ton/mm$^2$, the product of HRX (HR40) series manufactured by Mitsubishi Rayon Inc. and the product M40J manufactured by Toray Industries Inc. were used.

As the reinforcing fiber having the tensile modulus of elasticity of 15 ton/mm$^2$, the product XN-15 manufactured by Nippon Graphite Inc. was used.

As the reinforcing fiber having the tensile modulus of elasticity of 10 ton/mm$^2$, the product XN-10 manufactured by Nippon Graphite Inc. was used.

The present invention is not limited to the above-described embodiment. For example, the length of the prepreg constituting the tip-side reinforcing angular layer and the tip-side reinforcing straight layer can be altered appropriately so long as the prepreg is disposed in the range from the tip of the shaft 1 to the position located within 25% of the distance from the tip to the butt. In the embodiment, the prepreg 17 constituting the straight layer is disposed outward from the prepregs 15 and 16 constituting the angular layer. But the prepreg 17 may be disposed inward from the prepregs 15 and 16.

Examples 1 through 4 of the golf club shaft of the present invention and comparison examples 1 through 4 will be described in detail below. As shown in table 1, the shafts of the examples and those of the comparison examples were formed by altering the orientation angle of the fiber of the tip-side reinforcing angular layer, the tensile modulus of elasticity of the reinforcing fiber of the angular layer and the straight layer, the ratio of the weight of the straight layer to that of the angular layer, the diameter of the tip, and the range of the tip-side reinforcing layer.

EXAMPLE 1

The shaft of the example 1 was similar to that of the first embodiment in its construction. More specifically, the tip-side reinforcing layer was formed in the range from the tip of the shaft to the position located at 20% of the distance from the tip to the butt. The fifth-layer and sixth-layer prepregs were formed as the tip-side reinforcing angular layers. The reinforcing fiber of the fifth-layer prepreg and that of the sixth-layer prepreg had an orientation angle of −45 and +45° respectively. The reinforcing fiber of each of the fifth-layer prepreg and the sixth-layer prepreg had a tensile modulus of elasticity of 24 ton/mm$^2$. The seventh-layer prepreg was formed as the tip-side reinforcing straight layer. The reinforcing fiber of the seventh-layer prepreg had a tensile modulus of elasticity of 10 ton/mm$^2$. The ratio of the weight of the tip-side reinforcing straight layer to that of the tip-side reinforcing angular layer was set to 0.7. The diameter of the tip of the shaft was set to 10.0 mm. The length of the shaft was set to 991 mm. The minimum value of the flexural rigidity (EI) in the range from the tip of the shaft to the position located at 25% of the distance from the tip to the butt was set to 1.25.

As the reinforcing fiber of the first layer prepreg, the second-layer prepreg, and the fourth-layer prepreg, the product 8255S-10 manufactured by Toray Industries Inc. was used. As the reinforcing fiber of the third-layer prepreg, the fifth-layer prepreg, the sixth-layer prepreg, the eighth-layer prepreg, and the ninth-layer prepreg, the product 3255G-10 manufactured by Toray Industries Inc. was used. As the reinforcing fiber of the seventh-layer prepreg, the product1026A-10N manufactured by Nippon Graphite Fiber Inc. was used.

EXAMPLE 2

The tip-side reinforcing layer was formed in the range from the tip of the shaft to the position located at 25% of the distance from the tip to the butt. The fifth-layer and sixth-layer prepregs were formed as the tip-side reinforcing angular layers. The reinforcing fiber of the fifth-layer prepreg and that of the sixth-layer prepreg had an orientation angle of −60° and +60° respectively. The reinforcing fiber of each of

TABLE 1

| | E1 | E2 | E3 | E4 | CE1 | CE2 | CE3 | CE4 | CE5 |
|---|---|---|---|---|---|---|---|---|---|
| Orientation angle of fiber of fifth and sixth layer angular layers | ±45° | ±60° | ±20° | ±45° | ±15° | ±45° | ±45° | ±45° | ±45° |
| Tensile modulus of elasticity of fifth and sixth layer angular layers | 24 t | 30 t | 30 t | 40 t | 24 t | 10 t | 24 t | 24 t | 24 t |
| Tensile modulus of elasticity of seventh straight layer | 10 t | 15 t | 5 t | 10 t | 10 t | 10 t | 10 t | 10 t | 10 t |
| Ratio of weight of straight layer to that of angular layer | 0.70 | 0.75 | 0.80 | 0.80 | 0.60 | 0.70 | 0.70 | 0.20 | 1.20 |
| Tip diameter (mm) and whole length (mm) of shaft | 10.0<br>991 | 9.5<br>991 | 10.0<br>991 | 12.0<br>991 | 9.5<br>991 | 9.5<br>991 | 8.0<br>1143 | 10.0<br>991 | 10.0<br>991 |
| Minimum value (kg · m$^2$) of flexural rigidity (EI) in range from tip of shaft to position located at 25% of distance from tip to butt | 1.25 | 1.30 | 1.50 | 2.20 | 1.20 | 0.92 | 0.80 | 0.78 | 2.60 |
| Three-point flexural strength at point T (kgf) | 200 kgf | 190 kgf | 195 kgf | 180 kgf | 210 kgf | 100 kgf | 110 kgf | 110 kgf | 150 kgf |
| Shock energy | 3.50 J | 3.35 J | 4.00 J | 3.10 J | 3.60 J | 2.00 J | 2.10 J | 2.05 J | 2.80 J |
| Durability test | ○ | ○ | ○ | ○ | ○ | X | X | X | ○ |
| Ball-hitting test | ◎ | ○ | ○ | ○ | Δ | X | X | X | X |

(t = ton/mm$^2$)
where E denotes example and where CE denotes comparison example.

the fifth-layer prepreg and the sixth-layer prepreg had a tensile modulus of elasticity of 30 ton/mm$^2$. The seventh-layer prepreg was formed as the tip-side reinforcing straight layer. The reinforcing fiber of the seventh-layer prepreg had a tensile modulus of elasticity of 15 ton/mm$^2$. The ratio of the weight of the tip-side reinforcing straight layer to that of the tip-side reinforcing angular layer was set to 0.75. The diameter of the tip of the shaft was set to 9.5 mm. The length of the shaft was set to 991 mm. The minimum value of the flexural rigidity (EI) in the range from the tip to the position located at 25% of the distance from the tip to the butt was set to 1.30.

As the reinforcing fiber of the first layer prepreg, the second-layer prepreg, the fourth-layer prepreg, the fifth-layer prepreg, and the sixth-layer prepreg, the product 8255S-10 manufactured by Toray Industries Inc. was used. As the reinforcing fiber of the third-layer prepreg, the eighth-layer prepreg, and the ninth-layer prepreg, the product 3255G-10 manufactured by Toray Industries Inc. was used. As the reinforcing fiber of the seventh-layer prepreg, the product E1526C-10N manufactured by Nippon Graphite Fiber Inc. was used. The other specifications of the example 2 were similar to that of the example 1.

EXAMPLE 3

The tip-side reinforcing layer was formed in the range from the tip of the shaft to the position located 15% of the distance from the tip to the butt. The fifth-layer and sixth-layer prepregs were formed as the tip-side reinforcing angular layers. The reinforcing fiber of the fifth-layer prepreg and that of the sixth-layer prepreg had an orientation angle of −20° and +20° respectively. The reinforcing fiber of each of the fifth-layer prepreg and the sixth-layer prepreg had a tensile modulus of elasticity of 30 ton/mm$^2$. The seventh-layer prepreg was formed as the tip-side reinforcing straight layer. The reinforcing fiber of the seventh-layer prepreg had a tensile modulus of elasticity of 5 ton/mm$^2$. The ratio of the weight of the tip-side reinforcing straight layer to that of the tip-side reinforcing angular layer was set to 0.80. The diameter of the tip of the shaft was set to 10.0 mm. The length of the shaft was set to 991 mm. The minimum value of the flexural rigidity (EI) in the range from the tip to the position located at 25% of the distance from the tip to the butt was set to 1.50.

As the reinforcing fiber of the first layer prepreg, the second-layer prepreg, the fourth-layer prepreg, the fifth-layer prepreg, and the sixth-layer prepreg, the product 8255S-10 manufactured by Toray Industries Inc. was used. As the reinforcing fiber of the third-layer prepreg, the eighth-layer prepreg, and the ninth-layer prepreg, the product 3255G-10 manufactured by Toray Industries Inc. was used. As the reinforcing fiber of the seventh-layer prepreg, the product E052AA-10N (5 ton/mm$^2$) manufactured by Nippon Graphite Fiber Inc. was used. The other specifications of the example 3 were similar to that of the example 1.

EXAMPLE 4

The tip-side reinforcing layer was formed in the range from the tip of the shaft to the position located 10% of the distance from the tip to the butt. The fifth-layer and sixth-layer prepregs were formed as the tip-side reinforcing angular layers. The reinforcing fiber of the fifth-layer prepreg and that of the sixth-layer prepreg had an orientation angle of −45° and +45° respectively. The reinforcing fiber of each of the fifth-layer prepreg and the sixth-layer prepreg had a tensile modulus of elasticity of 10 ton/mm$^2$. The seventh-layer prepreg was formed as the tip-side reinforcing straight layer. The reinforcing fiber of the seventh-layer prepreg had a tensile modulus of elasticity of 10 ton/mm$^2$. The ratio of the weight of the tip-side reinforcing straight layer to that of the tip-side reinforcing angular layer was set to 0.80. The diameter of the tip of the shaft was set to 12.0 mm. The length of the shaft was set to 991 mm. The minimum value of the flexural rigidity (EI) in the range from the tip to the position located at 25% of the distance from the tip to the butt was set to 2.20.

As the reinforcing fiber of the first layer prepreg, the second-layer prepreg, and the fourth-layer prepreg, the product 3255S-10 manufactured by Toray Industries Inc. was used. As the reinforcing fiber of the third-layer prepreg, the eighth-layer prepreg, and the ninth-layer prepreg, the product 3255G-10 manufactured by Toray Industries Inc. was used. As the reinforcing fiber of the fifth-layer prepreg, and the sixth-layer prepreg, the product 16255G-10 (10 ton/mm$^2$) manufactured by Toray Industries Inc. was used. As the reinforcing fiber of the seventh-layer prepreg, the product E1026A-10N manufactured by Nippon Graphite Fiber Inc. was used. The other specifications of the example 4 were similar to that of the example 1.

COMPARISON EXAMPLE 1

The tip-side reinforcing layer was formed in the range from the tip of the shaft to the position located at 20% of the distance from the tip to the butt. The fifth-layer and sixth-layer prepregs were formed as the tip-side reinforcing angular layers. The reinforcing fiber of the fifth-layer prepreg and that of the sixth-layer prepreg had an orientation angle of −15° and +15° respectively. The reinforcing fiber of each of the fifth-layer prepreg and the sixth-layer prepreg had a tensile modulus of elasticity of 24 ton/mm$^2$. The seventh-layer prepreg was formed as the tip-side reinforcing straight layer. The reinforcing fiber of the seventh-layer prepreg had a tensile modulus of elasticity of 10 ton/mm$^2$. The ratio of the weight of the tip-side reinforcing straight layer to that of the tip-side reinforcing angular layer was set to 0.60. The diameter of the tip of the shaft was set to 9.5 mm. The length of the shaft was set to 991 mm. The minimum value of the flexural rigidity (EI) in the range from the tip to the position located at 25% of the distance from the tip to the butt was set to 2.60.

As the reinforcing fiber of the first layer prepreg, the second-layer prepreg, and the fourth-layer prepreg, the product 8255S-10 manufactured by Toray Industries Inc. was used. As the reinforcing fiber of the third-layer prepreg, the fifth-layer prepreg, the sixth-layer prepreg, the eighth-layer prepreg, and the ninth-layer prepreg, the product 3255G-10 manufactured by Toray Industries Inc. was used. As the reinforcing fiber of the seventh-layer prepreg, the product E1026A-10N manufactured by Nippon Graphite Fiber Inc. was used. The other specifications of the comparison example 1 were similar to that of the example 1.

COMPARISON EXAMPLE 2

The tip-side reinforcing layer was formed in the range from the tip of the shaft to the position located 60% of the distance from the tip to the butt. The fifth-layer and sixth-layer prepregs were formed as the tip-side reinforcing angular layers. The reinforcing fiber of the fifth-layer prepreg and that of the sixth-layer prepreg had an orientation angle of −45° and +45° respectively. The reinforcing fiber of each of the fifth-layer prepreg and the sixth-layer prepreg had a tensile modulus of elasticity of 10 ton/mm$^2$. The seventh-layer prepreg was formed as the tip-side reinforcing straight layer. The reinforcing fiber of the seventh-layer prepreg had a tensile modulus of elasticity of 10 ton/mm$^2$. The ratio of the weight of the tip-side reinforcing straight layer to that of the tip-side reinforcing angular layer was set to 0.70. The diameter of the tip of the shaft was set to 9.5 mm. The length of the shaft was set to 991 mm. The minimum value of the flexural rigidity (EI) in the range from the tip to the position located at 25% of the distance from the tip to the butt was set to 0.92.

As the reinforcing fiber of the first layer prepreg, the second-layer prepreg, and the fourth-layer prepreg, the product 8255S-10 manufactured by Toray Industries Inc. was used. As the reinforcing fiber of the third-layer prepreg, the eighth-layer prepreg, and the ninth-layer prepreg, the product 3255G-10 manufactured by Toray Industries Inc. was used. As the reinforcing fiber of the fifth-layer prepreg, and the sixth-layer prepreg, and the seventh-layer prepreg, the product E1026A-10N manufactured by Nippon Graphite Fiber Inc. was used. The other specifications of the comparison example 2 were similar to that of the example 1.

COMPARISON EXAMPLE 3

The tip-side reinforcing layer was formed in the range from the tip of the shaft to the position located at 25% of the distance from the tip to the butt. The fifth-layer and sixth-layer prepregs were formed as the tip-side reinforcing angular layers. The reinforcing fiber of the fifth-layer prepreg and that of the sixth-layer prepreg had an orientation angle of −45° and +45° respectively. The reinforcing fiber of each of the fifth-layer prepreg and the sixth-layer prepreg had a tensile modulus of elasticity of 24 ton/mm$^2$. The seventh-layer prepreg was formed as the tip-side reinforcing straight layer. The reinforcing fiber of the seventh-layer prepreg had a tensile modulus of elasticity of 10 ton/mm$^2$. The ratio of the weight of the tip-side reinforcing straight layer to that of the tip-side reinforcing angular layer was set to 0.70. The diameter of the tip of the shaft was set to 8.0 mm. The length of the shaft was set to 1143 mm. The minimum value of the flexural rigidity (EI) in the range from the tip to the position located at 25% of the distance from the tip to the butt was set to 0.80.

As the reinforcing fiber of the first layer prepreg, the second-layer prepreg, and the fourth-layer prepreg, the product 8255S-10 manufactured by Toray Industries Inc. was used. As the reinforcing fiber of the third-layer prepreg, the fifth-layer prepreg, the sixth-layer prepreg, the eighth-layer prepreg, and the ninth-layer prepreg, the product 3255G-10 manufactured by Toray Industries Inc. was used. As the reinforcing fiber of the seventh-layer prepreg, the product E1026A-10N manufactured by Nippon Graphite Fiber Inc. was used. The other specifications of the comparison example 3 were similar to that of the example 1.

COMPARISON EXAMPLE 4

The tip-side reinforcing layer was formed in the range from the tip of the shaft to the position located at 20% of the distance from the tip to the butt. The fifth-layer and sixth-layer prepregs were formed as the tip-side reinforcing angular layers. The reinforcing fiber of the fifth-layer prepreg and that of the sixth-layer prepreg had an orientation angle of −45° and +45° respectively. The reinforcing fiber of each of the fifth-layer prepreg and the sixth-layer prepreg had a tensile modulus of elasticity of 24 ton/mm$^2$. The seventh-layer prepreg was formed as the tip-side reinforcing straight layer. The reinforcing fiber of the seventh-layer prepreg had a tensile modulus of elasticity of 10 ton/mm$^2$. The ratio of the weight of the tip-side reinforcing straight layer to that of the tip-side reinforcing angular layer was set to 0.20. The diameter of the tip of the shaft was set to 10.0 mm. The length of the shaft was set to 991 mm. The minimum value of the flexural rigidity (EI) in the range from the tip to the position located at 25% of the distance from the tip to the butt was set to 0.78.

As the reinforcing fiber of the first layer prepreg, the second-layer prepreg, and the fourth-layer prepreg, the product 8255S-10 manufactured by Toray Industries Inc. was used. As the reinforcing fiber of the third-layer prepreg, the fifth-layer prepreg, the sixth-layer prepreg, the eighth-layer prepreg, and the ninth-layer prepreg, the product 3255G-10 manufactured by Toray Industries Inc. was used. As the reinforcing fiber of the seventh-layer prepreg, the product E1026A-10N manufactured by Nippon Graphite Fiber Inc. was used. The other specifications of the comparison example 3 were similar to that of the example 1.

COMPARISON EXAMPLE 5

The tip-side reinforcing layer was formed in the range from the tip of the shaft to the position located at 20% of the distance from the tip to the butt. The fifth-layer and sixth-layer prepregs were formed as the tip-side reinforcing angular layers. The reinforcing fiber of the fifth-layer prepreg and that of the sixth-layer prepreg had an orientation angle of −45° and +45° respectively. The reinforcing fiber of each of the fifth-layer prepreg and the sixth-layer prepreg had a tensile modulus of elasticity of 24 ton/mm$^2$. The seventh-layer prepreg was formed as the tip-side reinforcing straight layer. The reinforcing fiber of the seventh-layer prepreg had a tensile modulus of elasticity of 10 ton/mm$^2$. The ratio of the weight of the tip-side reinforcing straight layer to that of the tip-side reinforcing angular layer was set to 1.20. The diameter of the tip of the shaft was set to 10.0 mm. The length of the shaft was set to 991 mm. The minimum value of the flexural rigidity (EI) in the range from the tip to the position located at 25% of the distance from the tip to the butt was set to 2.60.

As the reinforcing fiber of the first layer prepreg, the second-layer prepreg, and the fourth-layer prepreg, the product 8255S-10 manufactured by Toray Industries Inc. was used. As the reinforcing fiber of the third-layer prepreg, the fifth-layer prepreg, the sixth-layer prepreg, the eighth-layer prepreg, and the ninth-layer prepreg, the product 3255G-10 manufactured by Toray Industries Inc. was used. As the reinforcing fiber of the seventh-layer prepreg, the product E1026A-10N manufactured by Nippon Graphite Fiber Inc. was used. The other specifications of the comparison example 4 were similar to that of the example 1.

By using a method which will be described below, the three-point flexural strength test, the shock test, the durability test, the ball-hitting evaluation were conducted for the golf club of each of the examples and the comparison examples.

Three-Point Flexural Strength Test

The strength of a point T (distant by 90 cm from tip of shaft) was measured in conformity to the shaft three-point flexural strength test of SG mark method. As the measuring apparatus, an Intesco manufactured by Intesco Inc. was used.

Shock Test

A shock was generated by each shaft by dropping a weight having 1 kgf from a point 1500 mm above the horizontal surface so that the weight collided with the shaft. The shock at the time (acceleration) of the collision between the weight and the shaft was recorded, and energy computations were performed.

Durability Test

Using a swing robot manufactured by Miyamae Inc., a position between the face center and the heel was hit at a head speed of 51 m/second. Shafts not broken were marked by ○, whereas those broken were marked by X.

Ball-Hitting Test

Fifty golf players were requested to hit balls to evaluate whether their hands felt vibrations after they hit the balls. Shafts that gave vibrations and shocks to the golf layers to a very low extent were marked by . Shafts that gave vibrations and shocks to them to a low extent were marked by ○. Shafts that gave vibrations and shocks to them to a high extent were marked by X. Regarding the evaluation method, for example, when the number of the mark ○ was larger than that of the marks and X, the mark ○ was given for each of the examples and the comparison examples.

As indicated in table 1, the shafts of the examples 1 through 4 were superior to those of comparison examples 1 through 5 in the three-point flexural strength test, the shock test, and the durability test. The shafts of the examples 1 through 4 were also superior to those of comparison examples 1 through 5 in the ball-hitting evaluation.

The shaft of each of the comparison examples 2 through 5 had less than 1.00 $kg \cdot m^2$ as the minimum value of the flexural rigidity (EI) in the region disposed from the tip to the position located at 25% of the distance from the tip to the butt. Therefore the shafts of the comparison examples 2 through 5 had a much lower strength than those of the examples at the tip side thereof.

As apparent from the foregoing description, according to the present invention, in the range from the tip of the shaft to the position located at 25% of the distance from the tip to its butt, the outer diameter of the shaft is set to the range of 9.5 to 12 mm larger than that of ordinary shafts. The minimum value of the flexural rigidity (EI) in the range is set to 1.00 to 2.50 $kg \cdot m^2$. Thus it is possible to make the circumferential bonding area of the shaft which is bonded to the head, which allows reduction of the bonding length of the shaft and that of the neck of the head in the axial length of the shaft. Thereby it is possible to lower the center of gravity of the head and make the shaft flexible without deteriorating the strength of the shaft at its tip side.

To make the shaft flexible, the reinforcing layer is formed at the tip side of the shaft. The reinforcing layer includes at least one straight layer consisting of the prepreg whose reinforcing fiber has a tensile modulus of elasticity of 5 to 15 ton/mm and is substantially parallel with the axis of the shaft; and at least one angular layer consisting of the prepreg whose reinforcing fiber has a tensile modulus of elasticity of 24 to 40 $ton/mm^2$ and an orientation angle of ±20 to 65° with respect to the axis of the shaft. Therefore even though the diameter of the shaft at its tip side is enlarged, the shaft is allowed to be sufficiently flexible without making the rigidity of the shaft too high. The reinforcing layer reduces a shock at a ball-hitting time without deteriorating the strength of the shaft and prevents the shaft from being broken. Further owing to the reinforcing layer, the shaft gives a good feeling to a player when the player hits a golf ball and can fly the golf ball in a high trajectory.

What is claimed is:

1. A golf club shaft, comprising fiber reinforced resin layers, wherein prepregs are disposed from the tip end to the butt end and the area of these prepregs gradually decreases from the butt side to the tip side, the golf club shaft has an outer diameter of 10 to 12 mm in at least one portion of a range from a tip thereof disposed at a head-mounting side to a position located at 25% of a distance from said tip to a butt thereof; a minimum value of a flexural rigidity (El) is in a range of 1.00 to 2.50 $kg \cdot m^2$; and a reinforcing layer is disposed from said tip to said position located at 25% of said distance from said tip to said butt, and said reinforcing layer includes:

a straight layer consisting of a prepreg having reinforcing fiber with a tensile modulus of elasticity of 5 to 15 $ton/mm^2$ which is substantially parallel with an axis of said shaft;

an angular layer consisting of a prepreg having reinforcing fiber with a tensile modulus of elasticity of 24 to 40 $ton/mm^2$ and an orientation angle of ±20 to 65° with respect to said axis of said shaft; and wherein prepregs disposed only on the tip side make up the straight layer and the angular layer.

2. The golf club shaft according to claim 1, wherein the ratio of the weight of the straight layer to the angular layer is from 0.7 to 0.8.

3. The golf club shaft according to claim 1, wherein the prepregs which are disposed from the tip end to the butt end make up straight layers and angular layers.

4. The golf club shaft according to claim 3, wherein:

there are five prepregs disposed from the tip end to the butt end; and there are three prepregs disposed on the tip side making up the straight layer and the angular layer, one of the three prepregs making up the straight layer, and two of the three prepregs making up the angular layer.

5. The golf club shaft according to claim 1, wherein the area of the prepregs disposed only on the tip side gradually decreases from the tip side to the butt side.

* * * * *